US005079886A

United States Patent [19]

Downs

[11] Patent Number: 5,079,886

[45] Date of Patent: Jan. 14, 1992

[54] DECORATIVE PANEL

[76] Inventor: Gary L. Downs, 9401 NW. Barry Rd., Kansas City, Mo. 64152

[21] Appl. No.: 525,601

[22] Filed: May 21, 1990

[51] Int. Cl.[5] ..... E06B 3/30

[52] U.S. Cl. ..... 52/314; 52/308; 52/202; 52/307

[58] Field of Search ..... 52/202, 314, 307, 308

[56] References Cited

U.S. PATENT DOCUMENTS

| | | | |
|---|---|---|---|
| 2,059,489 | 11/1936 | Reisig | 52/307 |
| 2,196,109 | 4/1940 | Eastus | 52/307 |
| 2,379,595 | 7/1945 | Roe . | |
| 2,482,339 | 9/1949 | Hibbard et al. . | |
| 2,841,004 | 7/1958 | Maccaferri . | |
| 2,859,607 | 11/1958 | Makray . | |
| 3,056,235 | 10/1962 | Makray . | |
| 3,177,279 | 4/1965 | Bilodeau | 52/314 |
| 3,193,434 | 7/1965 | Weiss | 52/307 |
| 3,270,473 | 9/1966 | Smith . | |
| 3,460,303 | 8/1969 | Algrain et al. | 52/308 |
| 4,514,945 | 5/1985 | Menchetti et al. | 52/202 |

*Primary Examiner*—Richard E. Chilcot, Jr.

*Assistant Examiner*—Joanne C. Downs

*Attorney, Agent, or Firm*—Litman, McMahon & Brown

[57] ABSTRACT

A decorative panel which simulates the exposed surfaces of installed glass blocks. The panel, which is transparent, semi-transparent or translucent, has a variety of configurations simulating various combinations of 2", 3", 4", 6", and 12" glass blocks such that an installation of the panels in adjacent relationship can be adapted on-site to provide almost any rectangular planar area with the glass block effect. Each of the panels is adhesively secured to an existing planar glass surface therebeneath. A layer of air trapped between each of the relatively thin panels and the underlying glass surface provides a thermal barrier for insulating purposes. The underside of the panels can be tinted, frosted, etched or sculpted whereby a window containing the underlying glass surface is rendered translucent, providing visual security. A modified embodiment of the decorative panel is constructed of solid transparent, semi-transparent or translucent material for applications where the insulating air layer is not required or where a solid bordering edge is needed around an installation using panels having the insulating air layer.

2 Claims, 1 Drawing Sheet

DECORATIVE PANEL

FIELD OF THE INVENTION

The present invention relates to a transparent, semi-transparent or translucent panel for simulating glass blocks for decorative purposes and for generally providing a thermal barrier for insulating purposes.

BACKGROUND OF THE INVENTION

Construction costs for material and labor continue to rise at a seemingly ever-increasing rate. As a result, an ongoing search continues for methods in which various types of projects can be constructed at reduced cost without compromising esthetic and cosmetic benefits.

One particular area where such an application is relevant is for new or renovation construction utilizing glass blocks. Typically glass block construction involves the masoner's art whereby a plurality of similarly or variously sized individual glass units are spaced in adjacent relationship with mortar or other appropriate material spaced therebetween to assemble the blocks into a composite unit having the desired overall width and height dimensions.

Although construction with genuine glass blocks does provide a durable, weather resistant structure, several undesirable characteristics are introduced as well. First, glass blocks, as a building material, are relatively expensive. Second, installation of glass blocks requires a considerable amount of skill which is normally beyond that possessed by today's typical do-it-yourselfer.

Third, if natural light is to be conducted through the glass blocks, then the blocks must be installed in an opening whereby natural light energy can impinge on the glass blocks and, after being conducted through the blocks, be directed away thereform. Once installed, the glass blocks are more or less a permanent fixture until substantial renovation is subsequently performed. It is no simple matter to remove the installed glass blocks whenever an entirely different cosmetic effect is desired.

Fourth, sometimes a large, single-paned, glassed-in area has exposure to a temperature differential whereby substantial quantities of thermal energy are unnecessarily radiated away. The use of genuine glass blocks with air cells contained therein could potentially solve the energy loss problem while permitting some diffusion of light, but generally at substantial labor and material cost as aforedescribed.

Another application for glass blocks is to install them where light energy can be allowed to attractively penetrate therethrough while, at the same time, preventing unauthorized viewing therethrough by unwelcome observers.

SUMMARY OF THE INVENTION

A decorative panel is provided for securement to either the outer or inner (or both) surfaces of a planar glass pane. The panels are constructed of plastic or other resilient material and are generally adhesively secured to the glass pane with sealant or adhesive.

The panels have a variety of profiles to provide versatility in substantially covering any rectangularly shaped area. Each of the resilient panels can comprise a single simulated glass block or can be severed along the simulated mortar joints between adjacent simulated glass blocks. The inner profile of the simulated mortar joints has the same relative elevation as the original outer edges of the panel such that the modified panel bears substantially uniformly against the planar, supporting glass surface. For a particular application, a combination of panels is selected, appropriately cut apart along the simulated joints, and grouped together in order to substantially cover the entire available glass surface.

When secured to the glass supporting surface, the profiles of the various simulated glass blocks of the panel project outwardly therefrom substantially similarly to that of genuine glass blocks. Light rays striking either the panel or the glass supporting the panel are transmitted therethrough providing the desired illumination. If desired, such as for visual security purposes, the inner surface of the panel can be tinted, coated, etched or sculpted to further reduce the transparency of the panels, while maintaining a certain amount of translucency for illumination purposes.

An added benefit from the use of the panels arises from the fact that voids containing trapped air are enclosed between the inner surface of the panel and the surface of the supporting glass. Each of these voids forms a dead-air space, inhibiting the flow of thermal energy therethrough, thus providing an insulating barrier and preserving thermal energy which might otherwise be wasted.

One distinct advantage which the glass block decorative panels have over that of real glass blocks is the ability to remove the panels from the surface of the underlying supporting glass pane and to essentially restore the supporting glass to its pre-paneled configuration.

OBJECTS OF THE INVENTION

Therefore, the objects of the present invention are: to provide a decorative panel and a method for simulating installed glass blocks; to provide such a decorative panel which can be adhesively secured to an underlying planar glass surface; to provide such a decorative panel which can be subsequently removed from such underlying glass surface to susbstantially restore same to its previous pre-paneled condition; to provide such a decorative panel which entraps air in voids formed between the panel and an underlying glass surface; to provide such a decorative panel which can be utilized to reduce the transparency of a window while maintaining a certain amount of the translucency thereof; and to generally provide such a decorative panel which is relatively easy to install, simple to maintain, reliable in performance, inexpensive to manufacture, and which generally performs the requirements of its intended purposes.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 2:
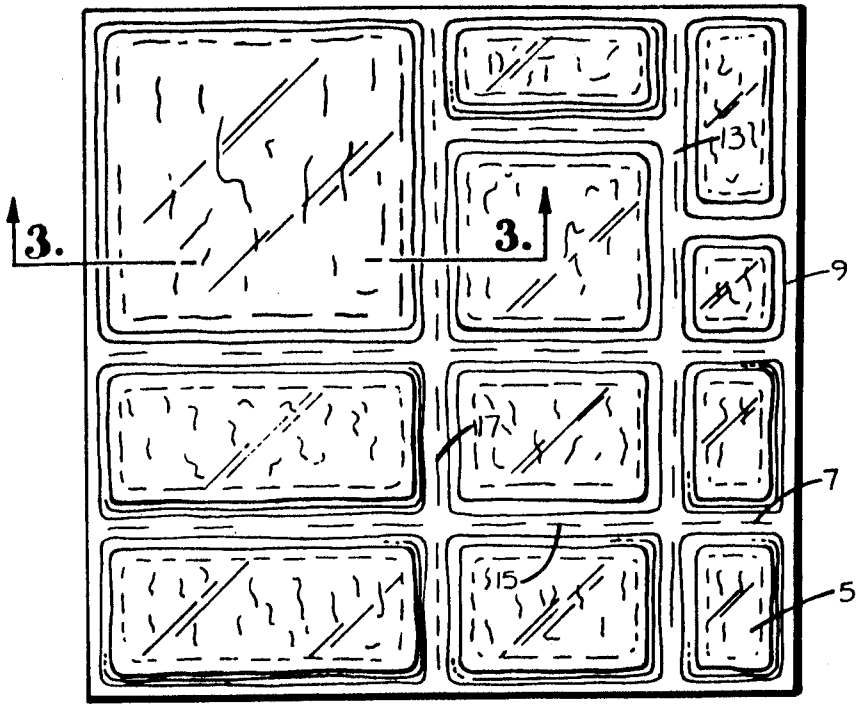
FIG. 2 is an enlarged front elevation view of the panel.
Figure 3:
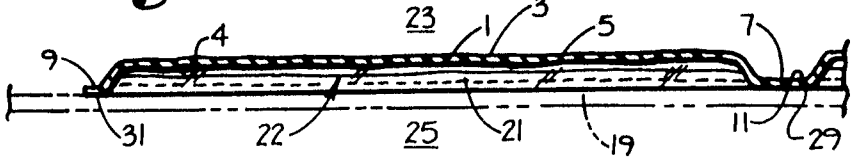
FIG. 3 is an enlarged and fragmentary cross-sectional view of the panel taken along line 3—3 of FIG. 2.
Figure 1:
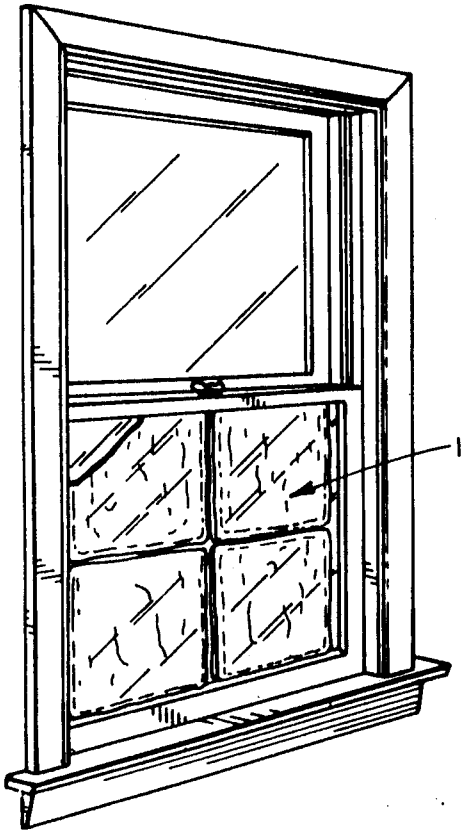
FIG. 1 is a perspective view of a window pane utilizing a decorative panel in accordance with the present invention.

The reference numeral 1 generally refers to a decorative panel in accordance with the present invention, shown in FIGS. 1 to 3. The tile or panel 1 is constructed of resilient, transparent, semi-transparent or translucent material, such as acrylic plastic or the like. Structure means, such as an outer surface 3, either alone or in combination with an underside or inner surface 4, of the panel 1 has a profile which simulates the exposed surfaces of installed glass blocks, sometimes collectively referred to as masonry tiles. Typically, the thickness of the profiles is approximately $\frac{3}{8}''$–$\frac{1}{2}''$.

The panel 1 has raised outer surface or elevated portions 5, each of which simulates the exposed surface of an installed glass block. Typically, the simulated glass blocks are rectangularly shaped with widths of 2", 3", 4", 6"or 12". It is to be understood that other sizes and shapes are equally applicable.

Between and separating the elevated portions 5 are recessed outer surface portions, grooves, partitions, or troughs 7, which simulate mortar joints between the elevated portions 5. Typically, the planar portion of each of the troughs 7 has a width of approximately $\frac{3}{8}''$. The trough 7 which runs along the entire peripheral edge of the panel 1, referenced by the numeral 9 in FIG. 2, has a width which is dimensioned approximately one-half of the width of the troughs 7 which are spaced between adjacently spaced elevated portions 5.

An outer surface 11 of each of the troughs 7 may be painted with an opaque paint, or otherwise colored or tinted, to simulate the various colors and appearance of mortar, which is used to install genuine glass blocks. For a particular application, each of the panels 1 may have relatively uniformly sized simulated glass blocks, as illustrated in FIG. 1, or have an assortment of differently sized simulated glass blocks, as shown in FIG. 2. It is foreseen that the panels 1 may be configured into several different patterns of randomly spaced and sized simulated glass blocks such that a non-repeating effect can be obtained if desired over a relatively large, rectangularly shaped area. It is also foreseen that the profile of the surface of the panel 1 can be configured to simulate non-rectangular shapes, such as bottles glass, triangularly shaped glass blocks, hexagonally shaped glass blocks, abstract designs or the like.

When one of the panels 1 needs to be modified in size for a particular application, the panel 1 can be severed along a line in a trough 7 approximately mid-way between two adjacently spaced simulated glass blocks such that the perimeter of the modified panel 1 comprises a peripheral trough 9 thereabout. Thus, where two of the panels 1, with one or both thereof being modified, are abutted and secured in adjacent relationship, the adjoining glass blocks in the adjacent panels 1 are separated by a trough 7 comprising two of the peripheral troughs 9 wherein the total composite width thereof is approximately equal to the width of one of the troughs 7.

To simplify adapting the panels 1 to substantially cover any rectangularly shaped area, some of the panels 1 may have a pattern similar to that shown in FIG. 2 where a trough 7, such as that referenced by the numeral 13, is spaced approximately 2" from the left edge of the panel 1, and a trough 7, such as that referenced by the numeral 15, is spaced approximately 3" from the bottom edge of the panel 1, and a trough 7, such as that referenced by the numeral 17, is spaced approximately 6" from the left edge of the panel 1. With that pattern, a 2" strip can be obtained by severing the panel 1 along the trough 13 and using the rightmost portion, a 3" strip can be obtained by severing the panel 1 along the trough 15 and using the bottommost portion, a 4" strip can be obtained by severing the panel 1 along the troughs 13 and 17 and using the portion therebetween, and a 6" strip can be obtained by severing the panel 1 along the trough 17 and using the leftmost portion. In addition, the simulated glass blocks can be constructed in a variety of sizes such that each simulated glass block is a separate panel 1, each with one of the peripheral troughs 9 thereabout.

Upon securement of the panel 1 to a supporting surface 19, a layer of air 21 is trapped in a depression, recess or pocket 22 between the panel 1 and the supporting surface 19. The layer 21 serves as an insulating dead-air space, thereby providing an improved thermal barrier between the spatial regions 23 and 25 on each side thereof. Thus, an application of the present invention could be utilized to reduce heat loss, such as with a large non-insulating glass window, with the aesthetic attribute being a beneficial byproduct.

When the panel 1 is fabricated, the material can be tinted to provide other aesthetic aspects. Also, the inner surface 4 of the panel 1 can be adapted to provide other visual variations and designs, such as by etching, tinting, sculpting, lightly spraying or the like. Such variations may be particularly useful when using the invention 1 for visual security purposes, such as on a bathroom window to prevent unauthorized viewing therethrough by unwelcome observers.

In an actual application of the present invention, a sufficient quantity of the panels 1, having appropriate profiles, is selected for covering the glass pane 19 which will serve as the supporting surface. The panels 1 are then severed along the appropriate troughs 7 such that the composite width and length of the panels 1 when in adjacent relationship will substantially cover an area corresponding to the width and length of the area to be covered.

An underside 29 of each of the troughs 7 and an underside 31 of each of the peripheral troughs 9 of each of the panels 1 is coated with a weather-resistant adhesive, such as silicone sealant or the like. With such an adhesive, the panels 1 can be used for either interior or exterior applications. Then, the panels 1 with the adhesive applied thereto are placed against the pane 19 in adjacent abutting relationship such that the adhesive bonds the panels 1 to the pane 19. If necessary, a temporary biasing force may be utilized to gently press the panels 1 against the pane 19 until the adhesive has effectively bonded the panels 1 thereto. If a narrow strip around the periphery of the pane 19 remains uncovered, moulding or other appropriate trim may be utilized to complete the installation.

If it should ever be desirable to restore the pane 19 back to its configuration which existed prior to installation of the panels 1, it is a simple matter to pry the panels 1 from the pane 19. A simple tool, such as a painter's razor-blade scraper, may then be used to scrape the remaining adhesive from the pane 19.

It is foreseen that the panels 1 may be secured to the pane 19 with a pressure-sensitive, double-sided tape, such as an air-tight foam tape, as manufactured by 3M Company, which is substantially resistant to the adverse effects of wind, water and ice.

Figure 4:
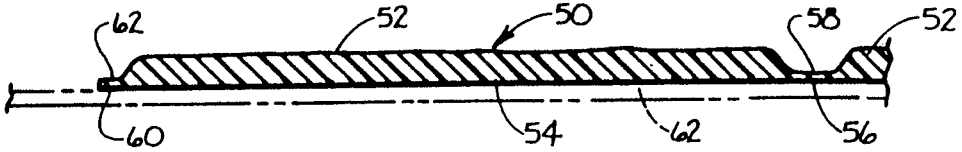
FIG. 4 is an enlarged and fragmentary cross-sectional view of a modified embodiment of a decorative panel in accordance with the present invention.

A modified embodiment 50 of a decorative panel in accordance with the present invention is shown in FIG. 4. Many of the characteristics of the modified embodiment 50 are substantially similar to those already described and will not be reiterated here.

Instead of being relatively thin with a reverse side adapted to entrap a layer of air, the modified embodiment 50 comprises simulated glass blocks 52, a back surface 54 of which is coplanar with a back surface 56 of a trough 58 separating the glass blocks 52 and with a back surface 60 of a peripheral trough 62. Application of the modified embodiment 50 would be particularly useful where insulating characteristics thereof are of minor importance.

In an actual application of the modified embodiment 50, an adhesive is distributed relatively uniformly over the surface 54 in order to secure the panel 50 to an underlying supporting surface 62. For such applications where such adhesive is visible through the panel 50, it is preferable that a clear adhesive be utilized.

Since the modified embodiment 50 is not hollow-backed, it is particularly applicable for providing a glass block effect to non-rectangularly shaped areas. Further, the modified embodiment 50 can be used to more precisely cover a rectangularly shaped area since the panels 50 can be severed as needed, even if such severing does not correspond with one of the troughs 58. In addition, the modified embodiment panels 50 can be used for the border of an area to be covered, while the aforedescribed embodiment panels 1 can be used for the central portion of the area to be covered in order to realize some of the insulating characteristics provided thereby.

It is foreseen that either embodiment of the present invention may be used for applications where the transmission of light energy therethrough is unnecessary. For those applications, where utilization of the profile of the glass block appearance is the primary objective, the panels may be mounted on a supporting surface or structure, opaque or otherwise. Such applications could include panels in furniture and the like.

It is to be understood that while certain forms of the present invention have been illustrated and described herein, it is not to be limited to the specific forms or arrangement of parts described and shown.

What is claimed and desired to be secured by Letters Patent is as follows:

1. A device for providing visual security for an existing, transparent glass pane having a planar glass surface, said device providing the pane with the appearance of a plurality of installed existing glass blocks wherein the existing glass blocks have a characteristic coloration, manufactured by the process comprising the steps of:

(a) providing a plurality of first rectangularly shaped panels having four sides, each said panel having:
  (1) a peripheral edge;
  (2) structure means for providing a low profile; said structure means including:
    (i) an outer surface having a peripheral trough running along each one of said four sides, adjacent to said peripheral edge, such that said peripheral trough along each said side simulates one-half of a mortar joint between two of the existing glass blocks, adjacently installed;
    (ii) a planar, back surface defined by said peripheral edge;
    (iii) profile means for providing said first panel with the appearance simulating one of the existing glass blocks; and
    (iv) said first panel constructed of severable, transparent plastic; and
  (3) tinting means for providing said first panel with the characteristic coloration of the existing glass blocks;

(b) providing a plurality of second rectangularly shaped panels similar to said first panels, each including a peripheral edge and structure means having an outer surface with a peripheral trough as aforesaid, each further including:
  (1) a planar, back surface defined by said panel peripheral edge and extending approximately behind said peripheral trough; and
  (2) an inner surface defined by said back surface; said inner surface recessed inwardly from said back surface toward said outer surface; and (c) adhesively removably securing said back surfaces of said first and second panels to the existing pane such that said second panels are secured in adjacent abutting relationship by said adhesive to the planar glass surface of the pane toward the center thereof and said first panels are severed and secured in adjacent abutting relationship and adjacent to said second panels by said adhesive to the planar glass surface of the pane such that a border is formed about said second panels by said first panels.

2. In combination with a window unit including a fixed sash with a frame and a recessed glass panel mounted therein and a movable sash with a frame and a recessed glass pane mounted therein, the improvement of a system for applying a decorative pattern of panels to said pane of said movable sash, which comprises:

(a) a multiple-segment panel including:
  (1) an outer surface;
  (2) an inner surface;
  (3) a generally rectangular configuration with four sides and a laterally-extending panel perimeter at said sides;
  (4) a network grid comprising multiple troughs recessed into said panel outer surface and criss-crossing at right angles with respect to each other;
  (5) a plurality of sets of discrete panel units each having a rectangular configuration and being bounded by said panel perimeter and/or multiple said troughs, said panel unit sets comprising:
    (i) a first set with length and width dimensions;
    (ii) a second set having a width dimension substantially equal to that of the first set and a length dimension substantially equal to one and one-half times the length dimension of the first set;

(iii) a third set having a width dimension substantially equal to two times the width dimension of the first set and a length dimension substantially equal to one and one-half times the length dimension of the first set;

(iv) a fourth set having a width dimension substantially equal to three times the width dimension of the first set and a length dimension substantially equal to one and one-half times the length dimension of the first set; and (v) a fifth set having a width dimension substantially equal to three times the width dimension of the first set and a length dimension substantially equal to three times the length dimension of the first set;

(b) a decorative pattern formed on said movable sash glass pane by said multiple panel units;

(c) means for separating said panel into multiple discrete panel units along said troughs whereby peripheral troughs are formed around each said panel unit, each said peripheral trough having a front surface and a back surface;

(d) adhesive means for adhesively fastening said panel units to said movable sash pane and including adhesive applied to said peripheral trough inner surfaces;

(e) finished troughs formed in said system by adjacent, respective perimeter troughs; and (f) means for providing said system with the appearance of glass blocks having mortar joints therebetween, said means comprising the juxtaposition of adjacent, respective perimeter troughs of said panel units.

* * * * *